United States Patent [19]

Myer

[11] 3,981,509

[45] Sept. 21, 1976

[54] LATCHING MEANS FOR RELEASABLY SUPPORTING A DRIVEN ROTATABLE MEMBER

[75] Inventor: William R. Myer, Frenchtown, N.J.

[73] Assignee: Geometric Machine and Design Corporation, Woodbridge, N.J.

[22] Filed: Oct. 31, 1974

[21] Appl. No.: 519,548

[52] U.S. Cl. ..... 279/1 R; 192/114 R; 242/68.4

[51] Int. Cl.[2] ..... B23B 33/00; B23Q 1/08

[58] Field of Search ..... 279/1 R, 1 DC; 242/68, 242/68.4, 58.6; 192/67 R, 114; 64/1

[56] References Cited

UNITED STATES PATENTS

| | | | |
|---|---|---|---|
| 1,803,180 | 4/1931 | Gargolinski | 242/68.4 |
| 2,488,231 | 11/1949 | Pegard | 192/67 R |
| 2,735,684 | 2/1956 | Longee et al. | 192/114 X |
| 2,739,685 | 3/1956 | Paulauich | 192/114 |
| 3,176,928 | 4/1965 | Saunders | 242/58.6 |
| 3,246,858 | 4/1966 | Alexeff | 242/68.4 |
| 3,480,225 | 11/1969 | Alexeff | 242/68.4 |

FOREIGN PATENTS OR APPLICATIONS

| | | | |
|---|---|---|---|
| 237,585 | 7/1969 | U.S.S.R. | 279/1 R |

*Primary Examiner*—J. M. Meister
*Assistant Examiner*—W. R. Briggs
*Attorney, Agent, or Firm*—Daniel H. Bobis

[57] ABSTRACT

Support and Latching Means for one end of a relatively heavy rotatable member having a housing with bearing means in the axial line of said rotatable member for supporting the rotatable member when engaged for rotation, arcuate wall means adjacent and concentric with the bearing means forms a transfer cavity to receive the supported end of the rotatable member in the disengaged position, a pass-thru opening in said bearing means, a transfer opening in said arcuate wall, said pass-thru opening sized less than the diameter of the supported end of the rotatable member and communicating with said transfer opening to permit the supported end of the rotatable member to be moved into and out of said housing and to hold the supported end in assembled position when the rotatable member is engaged for rotation, means operative to impart lateral movement to said rotatable member to move the same in said housing from the disengaged position in the transfer cavity to the engaged position in said bearing means, and a raised surface means adjacent the lowermost point of said transfer opening to prevent the rotatable member from escaping from the transfer cavity when the rotatable member is in the disengaged position.

Additionally, the combination of rotatable member for rewinding slit materials thereon with the support latching means above described on at least one end, and yoke means operatively associated with the support and latching means to permit engagement with the rewinding elements on the rotating member.

Additionally, the combination above described with support and latching means at both ends of the rotatable member, and coacting yoke means at each respective and operative with an associated support and latching means to engage the rewind elements on the rotatable members.

15 Claims, 7 Drawing Figures

LATCHING MEANS FOR RELEASABLY SUPPORTING A DRIVEN ROTATABLE MEMBER

BACKGROUND OF THE INVENTION

The invention relates generally to latching means for rewind mandrels on duplex slitting and rewinding machines and more particularly to a safety type support and latching means for removably supporting a rotatable member.

Duplex slitting and rewinding machines will include generally an unwind roll which has thereon uncoated, coated or impregnated materials to be slit and rewound, and at least one or more rewind mandrels on which the slit material is rewound.

Such rewind mandrels whether empty or wound with fabric or other materials are sufficiently large and heavy to require hoisting machinery for lifting the rolls to mount the same in the bearings or bearing housings and for moving the rewind mandrel into and out of engagement with the driving chuck or other driving means.

Various types of latching mechanism and driving connections are known for such rewind mandrels as is indicated by U.S. Pat. No. 2,735,684.

The present invention provides an improved safety type support and latching means which simplifies removal and replacement of such rewind mandrels, and includes safety means thereon to prevent accidental or inadvertent removal of the rewind mandrel from assembled position.

It allows for removal and replacement, without dismantling of any of the fixed or assembled portions of the machine.

SUMMARY OF THE INVENTION

Thus, the present invention covers a support and latching means for a rotatable member including, means for connecting the support and latching means adjacent one end of the rotatable member, said support and latching means bearing heavy means formed thereon for rotatably supporting said end of the rotatable manner, an arcuate wall means between said bearing means and the means for connecting the support and latching means forming a transfer cavity, said bearing means and transfer cavity disposed adjacent and concentive to each other and in the axial line of the rotatable member said arcuate wall means forming a transfer opening in communication with the transfer cavity to permit the end of the rotatable member to be moved into and out of said transfer cavity, and a raised support means disposed adjacent to and slightly higher than the lowermost end of the transport opening, the upper end of the arcuate wall means disposed to permit the supported end of the rotatable member to raise as it is moved in and out of the transport cavity, and said bearing means having an opening sized less than the diameter of the supported end of the rotatable member to prevent the escape thereof in the engaged position, and means operatively associated with the transfer cavity for engagement with the supported end of the rotatable member to move the same into position in the bearing means.

Additionally, the combination of spaced supports and a rotatable member to be mounted on said spaced supports, a driving means on one of the spaced supports disposed to engage one end of the rotatable member, a support and latching means on the other end of said spaced supports adjacent the other end of said rotatable member for supporting the same, at least one rewind means on said rotatable member, and at least one yoke means operatively associated with the support and latching means to permit engagement with the rewind means on the rotatable member and to permit assembly and disassembly of the supported end of the rotatable member into and out of the said support and latching means.

Other objects of the present invention will be more completely understood from the following description of one preferred form of apparatus in accordance with the present invention reference being made to the accompanying drawings wherein.

Figure 1:
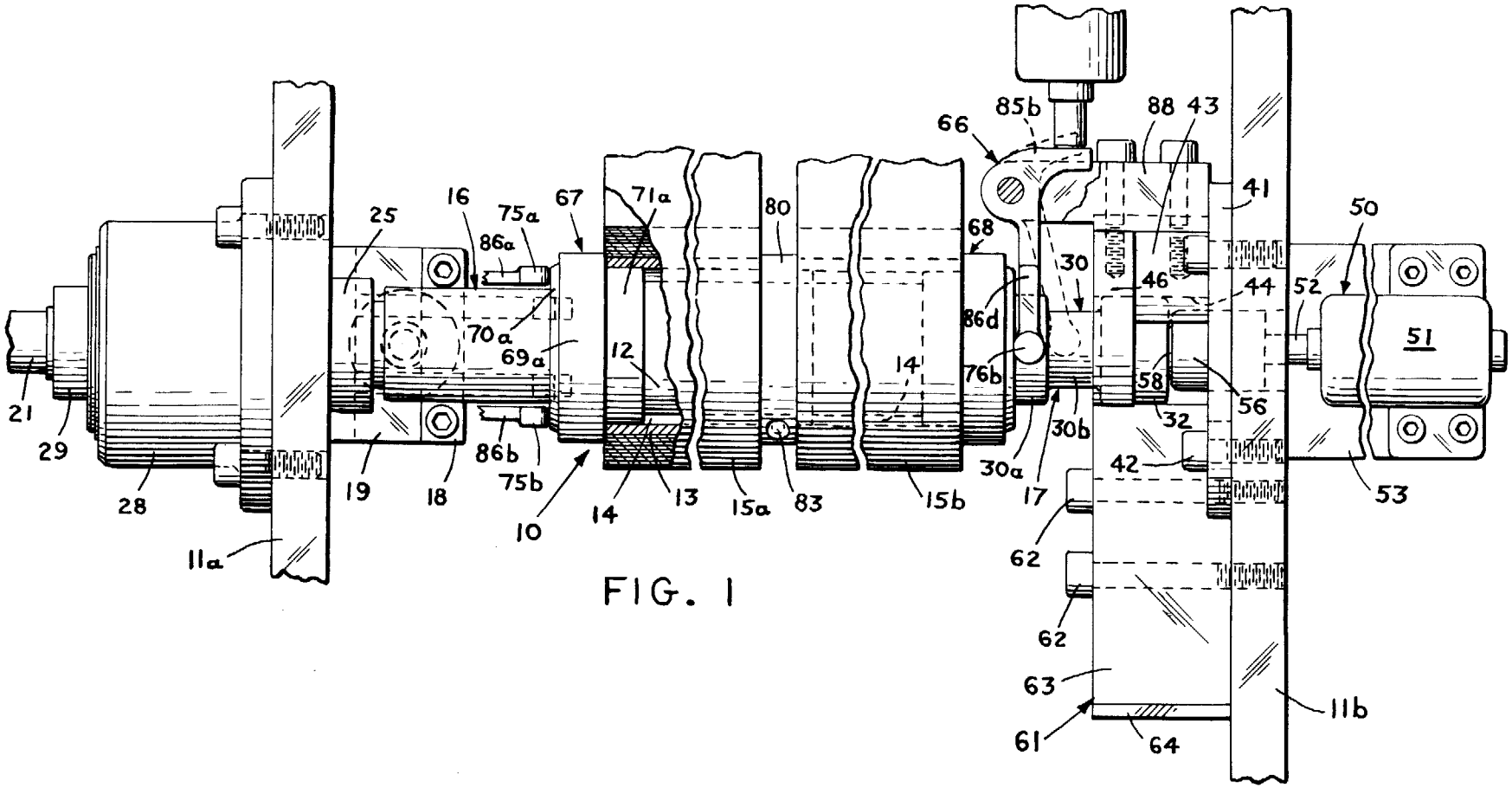
FIG. 1 is a top plan view of a support and latching means for releasable supporting a rotatable member in accordance with the present invention.
Figure 2:
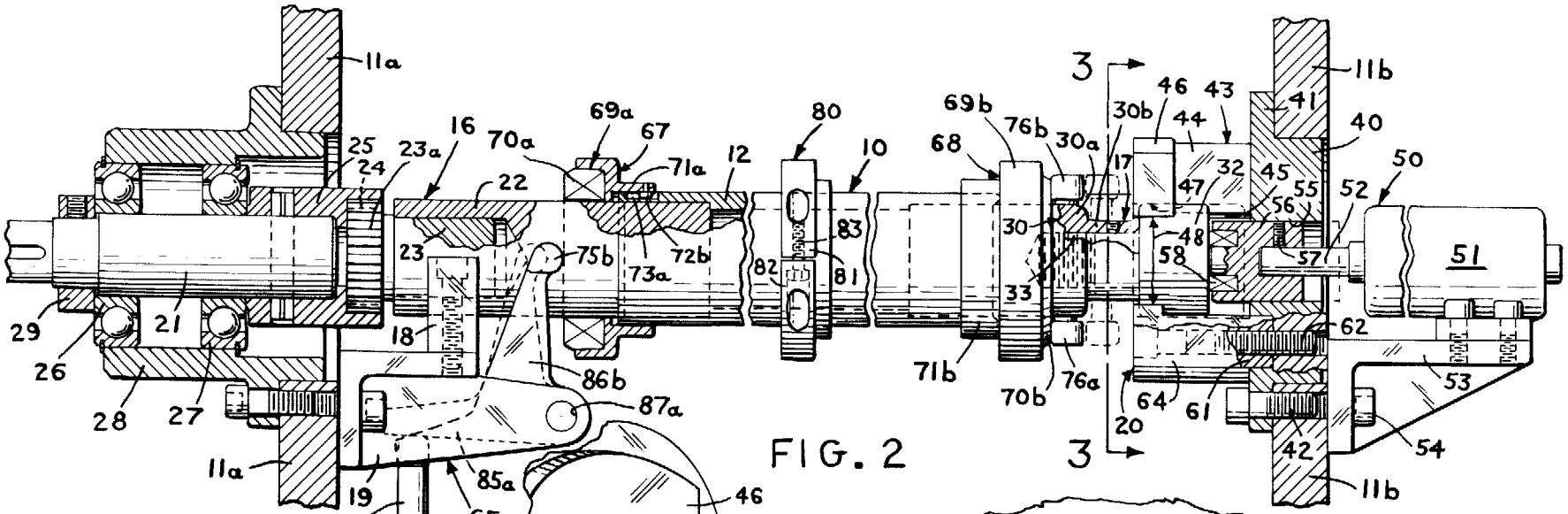
FIG. 2 is a side elevational view in partial vertical section through the various components forming the rotatable member and its associated support and latching means supporting one end thereof.

Referring to the drawings, FIGS. 1 and 2 show a rotatable member generally designated 10 such as rewind mandrel which will be mounted between the side frames 11*a* and 11*b*, only a fragment of which are shown, of a duplex slitter and rewinder apparatus not shown.

The entire duplex slitter and rewinder machine is not shown or described because such machines are known and easily purchasable on the open market and are only related to the subject matter disclosed herein to the extent that they form a preferred application to which the improvement is particularly applicable.

It will be understood by those skilled in the art that the rotatable member and the support and latching means therefor hereinafter more fully described is capable of other and varied uses where heavy removably mounted rotatable members are required.

The rotatable member or rewind mandrel 10 is an elongated element having a cylindrical center shaft 12 on which cardboard cores as at 13 and 14 are mounted to receive the slit lengths of fabric or other material 15*a* and 15*b* to be rewound.

Mounted in one end of the cylindrical center section 12 of the rewind mandrel 10 is driven means generally designated 16 and at the opposite end is an axle means generally designated 17. In assembled position as shown in FIGS. 1 and 2 of the drawings, the driven means 16 is supported at one end by a bearing element 18 connected by bracket 19 to the side frame 11*a* and at the opposite end the axle means 17 is mounted in a safety support and latching means generally designated 20 and more fully described hereinafter. The bearing element 18 is so aligned with the safety latch and supporting means 20 that the axial line of the rotatable member 10 will be absolutely parallel to the horizontal line of the apparatus in which it is mounted. Further, the safety support and latching means 20 so mounts the rotatable means or rewind mandrel 10 that it can be moved back and forth along its longitudinal axis to releasably connect the driven means 16 to the coupling end on the drive shaft 21 of the driving means, not shown.

The safety support and latching means 20 in which the axle means 17 is mounted will be constructed and arranged to coact with any suitable means generally designated 50 for exerting force along the longitudinal axis of the rotatable member or rewind mandrel 10 to move the rotatable member or rewind mandrel 10 from the disengaged position shown by the dotted lines in FIGS. 1 and 2 to the engaged position shown by the solid lines in these same figures.

The driven means 16 has a driven shaft 22 with a male spline member 23 fixedly connected to the end thereof remote from the cylindrical center section 12. The male spline member 23 has male splines 23a spaced a predetermined distance from the end of the driven shaft 22 and on longitudinal movement of the rotatable member or rewind mandrel 10 will engage female splines 24 formed in the end of a female spline member 25 which is fixedly connected to one end of the drive shaft 21. Drive shaft 21 is rotatably mounted in bearing means 26 and 27 in the bearing housing 28 and will be held by thrust collar 29 in assembled position. The drive shaft 21 is rotated by any suitable driving means such as an electric motor, not shown, which is connected to the drive shaft 21 by any suitable type of driving assembly such as a series of driven coacting gears; chain driven gears; a pulley and belt or any other arrangement, as is well known and therefore will be understood by those skilled in the art.

Figure 3:
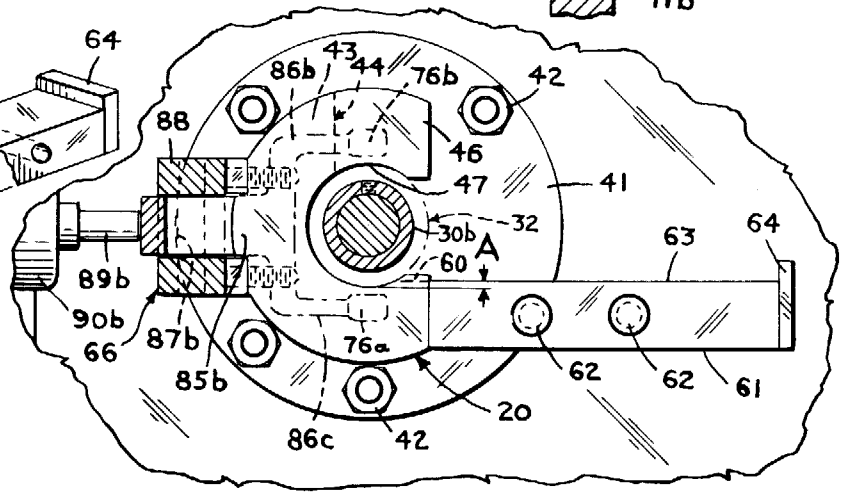
FIG. 3 is a view taken on line 3—3 showing an end view of the support and latching means shown in FIGS. 1 and 2.
Figure 5:
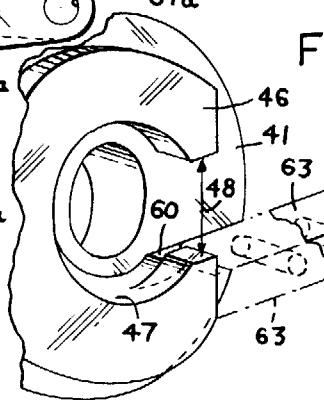
FIG. 5 is a rear angle perspective of the housing for the support and latching means shown in FIGS. 1 and 2.
Figure 4:
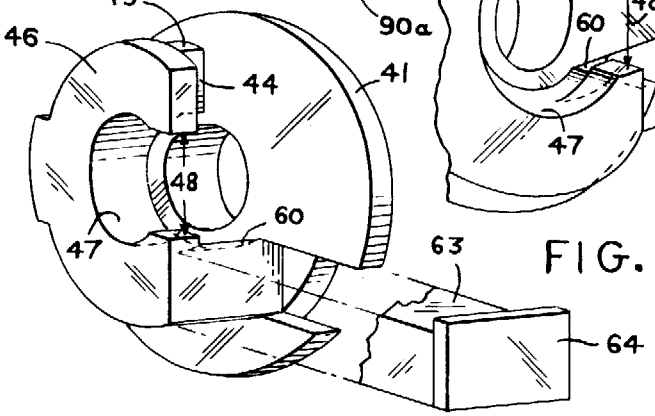
FIG. 4 is a front angle perspective of the housing for the support and latching means shown in FIGS. 1 and 2 with the raised platform for supporting the disengaged rotatable member broken away and phantomized.

At the opposite end of the rotatable member or rewind mandrel 10 remote from the driven means 16, the axle means 17 is shown to include, a supporting shaft 30 which is fixedly connected into the end of the cylindrical center member 12. The supporting shaft 30 has a large diameter at the section 30*a* connected into the center member 12 and a smaller diameter at the section 30*b* on the side remote from the center member 12 as is shown in FIGS. 1, 2 and 3 for reason that will appear clear in the description below respecting the removal of this supported end of the rotatable member 10 from its associated support and latching means 20.

A bearing and cam follower member 32 is threadably connected as at 33 into the end of the supporting shaft 30 and is locked in assembled position by the set screw 34.

The bearing and cam follower member 32 has a diameter adapted to fit, engage and rotate in bearing means and to slide in a transfer cavity provided in the safety support and latching means 20 in accordance with the present invention now to be described.

SAFETY SUPPORT AND LATCHING MEANS

The safety support and latching means 20 has a cylindrical base section 40, and a flange 41 is formed on the base section. Base section 40 and flange 41 are connected to the side frame 11*b* by circumferentially spaced threaded members 42.

Projecting from the base member 40 in a direction towards the opposite side member 11*a*, concentric to the longitudinal line of the rotatable member 10, is a C-shaped section 43 facing towards the direction for removing the rotatable member 10 from the side frames 11*a* and 11*b*.

The inner wall of the C-shaped section 43 defines a transfer cavity which communicates with the transfer opening 44. Transfer cavity 45 has a diameter approximately equal to the bearing and cam follower member 32. Further, the outer end of the transfer cavity 45 is adjacent to the flange section 41 and at the opposite or inner end is a C-shaped bearing means 46, to provide a width there between for the transfer cavity 45 at least twice the width of the female spline section 24 on the female spline member 25. This width will permit the bearing and cam follower member 86 and the rotatable member or rewind mandrel 10 connected thereto to be moved longitudinally to and fro along the axial line of the rotatable member 10 between the side frame members 11*a* and 11*b*. This longitudinal sidewise movement along the axial line of the rotatable member is particularly limited in the engaged or driving position by the female splined section 24 as shown by the solid lines and the dotted lines of FIGS. 1 and 2 of the drawings.

Reference to the drawings will show that the male splines 23a have a width approximately equal to that of the female splined section 24. Therefore, when such longitudinal sidewise movement of the rotatable member 10 occurs and because it is in the longitudinal line, the male splines 23*a* of the male spline section 23 dependent on the direction of movement, will engage with or disengage from the female splines 24 of the female spline member 25. The engaged position of the spline 23*a* and 23*b* acts as a limit stop for sidewise movement in one longitudinal direction and in the opposite direction the flange 41 acts as a limit stop for the disengaged position. However, since the transfer cavity is greater than the width of the female splined section 24, the rotatable member 10 is disengaged before it abuts the flange and is free to be removed as hereinafter more fully described.

FIG. 2 further shows that the C-shaped bearing means 46 has a centrally disposed opening 47 which forms a bearing surface for rotatably supporting the bearing and cam follower member when the rotatable member 10 is in driving engagement as above described. Opening 47 has a diameter equal to that of the transfer cavity 45 and therefore the bearing and cam follower 32 will slide smoothly into the bearing opening 47 on sidewise movement of the rotatable member 10 into position for driving engagement as is shown by the sold lines of FIGS. 1 and 2 of the drawings. The bearing and cam follower 32 in this position will support the rotatable member 10 during the rotation thereof and will be prevented from escaping from the supporting and latching mechanism 20 because the pass-thru passage or transport passage 48 formed by the C-shaped bearing means 46 and in communication with the bearing opening 47 is substantially less than the diameter of the bearing and cam follower member 32, as is shown at FIG. 2 and 3 of the drawings.

The transport opening 44 however in communication with the transport cavity is sufficiently large to permit the end of the rotatable member 10 having the support shaft 30 thereon to be swung, pivoted or rotated out of the safety support and latching means 20 after the rotatable member 10 is disengaged from the female splines 24 by longitudinal sidewise movement thereof in a direction towards the side frame 11b by any suitable hoisting means.

However, in order to permit such swinging, pivoting or rotating of the rotatable member when it is in the disengaged position, it is necessary that the lesser diameter section 30*b* of the supporting shaft 30 have a width larger than the width of the bearing means 46 and a diameter less than the pass-thru or transport passage 48, all of which is shown at FIG. 2 and 3 of the drawings.

Thus, once the rotatable member is in the engaged position it must be moved sidewise to the disengaged position by some suitable means such as a power lifting device not shown. In the disengaged position it can be removed from the duplex slitter and rewinder or other machine in which it is being used by swinging, pivoting, sliding, or roatating the same to facilitate this action.

The means to accomplish longitudinal movement to the engaged or driving position will first be more fully described and the characteristics of the safety support and latching means 20 to facilitate removal of the rotatable member will be further described.

Thus the longitudinal sidewise movement of the rotatable member towards side frame 11a is accomplished by the actuating means 50 which includes any suitable type of pneumatic, hydraulic or electrically operated device or motor generally designated 51 having a suitable plunger 52, which extends or retracts from the device or motor 51. Air operated motors, fluid operated motors and electrically operated motors of this type and construction are well known in the art, are easily purchasable on the open market and hence are not more fully described, as their structure and operation are known and understood by those skilled in the art.

The actuating device or motor 51 is connected to a bracket 53 mounted as by threaded member 54 to the side frame 11b so that the plunger 52 in the motor 51 is in alignment with an opening 55 through the base member 50 concentric to the axial line of the rotatable member 10. An actuating or jack shaft 56 on the plunger 52 is in sliding engagement with the opening 55 and transfer cavity 45 and is fixedly connected for movement with plunger 52 by means of the set screw 57. The end of the jack shaft 56 in communication with the transfer cavity 45 will have any suitable type of thrust bearing means 58 which as shown in FIG. 2 extends slightly beyond the adjacent end of the jack shaft 56. Thus, when the actuating device or motor 51 is activated to extend plunger 52, the jack shaft 56 fixedly connected thereto is thereby moved into engagement with the end face of the bearing and cam member 32. Relative axial or rotary movement between the rotatable member 10 and the jack shaft 56 can occur freely during such sidewise longitudinal movement because of the bearing means 58.

The rotatable member 10 can be moved sidewise by action of the actuating device 50 until the male splines 23a are fully engaged with the female splines 24 in the female spline member 25. When this occurs the rotatable member 10 will be fully engaged and can be rotated safely because the member 32 will be held in operating position in the bearing means 46.

SAFETY MEANS

In the opposite or disengaged position the heavy rotatable member or rewind mandrel 10 is prevented from escaping through the space formed by the transport opening 44 and transport passage 48.

To accomplish this, the lowermost edges of the transport opening 44 in the C-shaped projection 43 is provided with a lip or raised portion as at 60.

The pass-thru or transport passage 48 in communication with the opening 47 need only be sufficiently wide to permit the reduced section 30*b* on support shaft 30, which has a lesser diameter than the bearing and cam member 32; to pass therethrough as is shown in FIG. 2 of the drawings.

However, the lip or raised portion 60 on the lower edge of the transport opening 44 formed by the C-shaped projection 43 cannot be large because the transport opening 44 must be large enough to pass the bearing and cam 32.

Thus, by reference to FIG. 2, 3, 4 and 5, the lip or raised portion 60 is shown by the dotted lines and arrows at A as raised approximately 0.1 inch above a plane tangent with the transport opening 44 at a point perpendicular to the vertical diameter for the transport opening 44.

Remote from the raised position 60 the upper section of the transport cavity 45 in communication with the upper edge of the transport opening 44 must have sufficient clearance to permit the bearing and cam member 32 to raise as it is swung, pivited or rotated over the lip or raised section 60.

Figure 6:
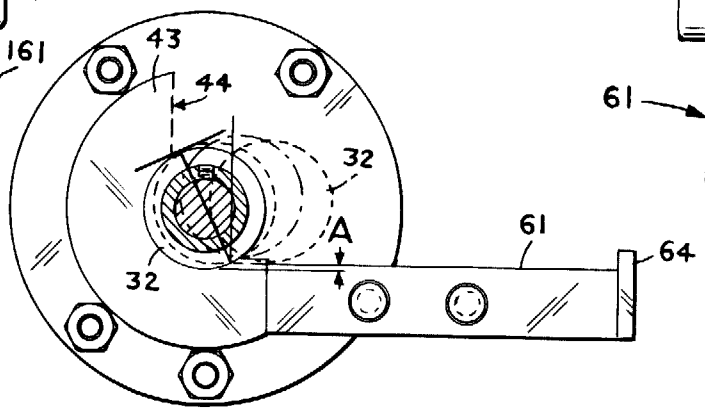
FIG. 6 is a diagramatic sketch showing in dotted position movement of the rotatable member from the support and latching means of the present invention.

To accomplish this the upper section of the transport cavity is cut back to remove an arcuate section from the vertical diameter of the transport cavity in a range which exceeds the point of tangency on the transport cavity provided by a line through the center of the transport cavity and the raised section 60; all of which is shown in FIG. 6 of the drawings.

Thus, for a raised section as at 60 of approximately 0.1 inch the arcuate upper section removed from the portion of the support and latching member 20 forming the transport opening about 10°. The optimum range of the raised section at A on the raised section 60 is between 0.05 inch TO 0.2 inch or about 2½% of the diameter of the bearing and cam member 32 and the arcuate section removed between the vertical diameter of the transfer cavity and the point of tangency thereon with the diameter and the raised section 60 as shown will be in a range from 5° to 20°.

Care must, of course, be taken to prevent removal of too much of the wall of the transport opening on the side remote from the raised section 60 or the heavy rotatable member may escape from the support and latching member 20 as will be understood by those skilled in the art.

Thus, in the engaged position the rotatable member 10 is held in assembled position due to the weight of the member and by reason of the narrow limits of the pass-thru or transport opening 48 in reason of the narrow limits of the pass-thru or transport opening 48 in the C-shaped bearing means 46.

In the disengaged position the rotatable member 10 is held in position by the weight of the member and the lip or raised section 60. Since the rotatable member 10 is static, the inertia of the member and the safety lip 60 prevent accidental or inadvertent escape of the bearing and cam member 32.

To facilitate removal of the rotatable member 10, a rest bracket is connected as by threaded member 62 to the flange 41 on base member 40 and the side frame 11b so that the upper surface 63 thereof is in alignment with the uppermost portion of the raised section 60. The end of the rest bracket has a bumper stop 64.

When the bearing and cam member 32 is moved out of the transfer cavity 45 for any reason, it is brought to rest on the rest on bracket 61.

This construction is particularly adapted in its preferred form to be used with a rewind mandrel of a duplex slitter and rewinder machine because it permits coaction with yoke members generally shown at 65 and 66. The yoke members coact with side collars 67 and 68 shown in FIGS. 1 and 2 for holding the cardboard cores 13 and 14 in position while fabric or other material as at 14 are wound thereon.

The side collar 67 and 68 are identical in construction and include a bearing holding section as at 69*a* and 69*b* for bearings 70*a* and 70*b* operatively connected on one side thereof and in running fit engagement therewith. On the side of the bearing holders 69*a* and 69*b* opposite from the bearings 70*a* and 70*b*, annular members 71*a* and 71*b* project in a plane concentric and parallel to the longitudinal line of the rotatable member or rewind mandrel 10.

The side collar 67 and 68 fit about opposite ends of the center shaft 12 of the rotatable member and are keyed thereto by key members 72*a* and 72*b*, not shown on the annular projections 71*a* and 71*b*. The key members 72*a* and 72*b* fitting into longitudinally extended grooves 73*a* and 73*b* not shown on the outer surface of the center shaft 12.

By reason of this connection the side collars 67 and 68 will rotate with the center shaft 12 and can slide to and fro relative the longitudinal axis to adjust to the associated cardboard core and the fabric being wound thereon under pressures exerted by the ends 75*a* and 75*b* of yoke element 65 against bearing 70*a* and 76*a* and 76*b* of yoke member 66 against bearing 70*b*. The bearing 70*a* and 70*b* may rotate or remain stationary depending on the frictional engagement between the bearings; and bearing holders and the end of the yoke elements.

The side collars 67 and 68 will coact with at least one intermediate collar 80. The intermediate collar 80 is a split member which can be opened to be fitted and adjusted to a given spaced distance from one or the other or both of the respective side collars 67 and 68. The associate ends 81 and 82 are connected by a set screw 83 which can be loosened to remove the intermediate collar 80 or to adjust the same along the longitudinal length of the rotatable member 10 the desired spaced distance for a coacting with the side collar 67 or 68 to hold a given cardboard core or cores. After the intermediate collar 80 has been adjusted it can be locked in position by tightening the set screw 83.

The yoke elements 65 and 66 are substantially identical in construction and have a reverse L shape in side view to form interconnected horizontal legs as at 85*a* and 85*b* and vertical legs 86*a* and 86*b* on the yoke elements 65 and 86*c* and 86*d* on the yoke element 66.

At the point of interconnection of these legs on each of the yoke elements 65 and 66 pivot opening 87*a* and 87*b* are formed which provide means to pivotally mount yoke element 65 in bracket 19 connected to the side frame 11*a* and yoke element 66 in bracket 88 connected to the safety support and latching means 20 so that the horizontal legs 85*a* and 85*b* are in position to be engaged and activated by plunger means 89*a* and 89*b* respectively on any type of pneumatic, hydraulic or electrically actuated motors 90*a* and 90*b* of the type which are well known and easily purchasable on the open market and therefor not be more fully described herein as they are known and well understood by those skilled in the art.

The ends 75*a* and 75*b* and 76*a* and 76*b* will be formed on the vertical legs 86*a* and 86*b* of the yoke elements 65 and vertical legs 86*c* and 86*d* of the yoke element 66 respectively.

When the plunger means 89*a* and 89*b* of the devices or motors 90*a* and 90*b* are activated, the plunger means 89*a* or 89*b* or both will extend and engage the horizontal legs 85*a* or 85*b* or both as the case may be. This will cause the yoke elements 65 or 66 or both to pivot so that the ends 75*a* and 75*b* and/or 76*a* and 76*b* will engage its associate bearings 70*a* or 70*b* as the case may be. The conditions for operation will determine when such actuation is necessary as this will be a function of the winding or other process to which the rotatable member 10 may be adapted.

Further FIGS. 1, 2 and 3 show that the yoke elements 65 and 66 must be particularly oriented to the rotatable member 10 so that the rotatable member 10 can be swung, pivoted or rolled to remove it from engagement with the safety latch and supporting means 20 and then to lift it from the machine or apparatus in which it is being utilized.

Thus, the yoke element 65 is disposed so that the U-shape vertical legs 85*a*, 86*a* and 86*b* are disposed to lie under the rotatable element 10 to permit the ends 75*a* and 75*b* thereon to lie on either side of the rotatable member between the bearing element 18 and the bearing 70*a* in the side collar 67.

The yoke element 66 is disposed so that the U-shaped vertical legs 86*c* and 86*d* are disposed to lie on the back or inner side of the rotatable element 10 to permit the ends 76*a* and 76*b* thereon to lie on either side of the rotatable member 10 between the safety support and latching means 20 and the bearing 70*b* on the side collar 68.

In this arrangement the rotatable member 10 when in the disengaged position can be swung, pivoted or rolled from the safety support and latching member 20 onto the rest or bracket 62 without interference from the yoke element 65, then it can be lifted off of the bearing support 18 and the rest or bracket 62 without interference from the yoke element 66 and in neither of these steps for removing the rotatable member 10 is it necessary to dismantle any portion of the machine in which the rotatable member is being used.

The steps for mounting the rotatable member into assembled position are the reverse of those set forth above. First the rotatable member is lifted and cradled into position on the bearing support 18 and rest or bracket 61 with the U-shaped vertical legs 86*a* and 86*b* of the yoke element 65 being positioned between the bearing support 18 and the bearing 70*a* on the side collar 67. The rotatable member 10 is then swung, pivoted or rolled until the bearing and cam member 32 on the support shaft 30 of the axle means 17 lies in the transfer cavity 45 as shown in FIGS. 1 and 2. In this position the U-shaped vertical legs 86*c* and 86*d* of the yoke element 66 are positioned between the safety support and latching member 20 and the bearing 70*b* of the side collar 68.

OPERATION

When the rotatable member 10 is mounted as above described the longitudinal actuating member 50 is placed into operation and plunger or cams 52 causes the jack shaft 56 to move the bearing and cam member 32 and the rotatable member 10 connected thereto sidewise along its longitudinal axis in a direction towards the side frame 11*a* until the male splines 23*a* engage the female splines 24.

Where the rotatable member 10 is used as a rewind mandrel the slit fabric ends are attached to the cardboard cores 13 or 14 or both, as the case may be and the motors 90*a* and 90*b* are activated to bring the ends 75*a*, 75*b*, 76*a* and 76*b* of the yoke elements 65 and 66 into engagement with the bearings 70*a* and 70*b*.

The rotatable member is now ready for operation and the driving means, not shown, is placed into operation rotating the driving shaft 21 which drives the rotatable member through the engaged splined means 23*a* and 24*b* above described.

When rotation is stopped the rotatable shaft can be removed by deactivating the longitudinal actuating moter 50. This causes the plunger 52 to retract leaving the transport space 45 free to receive the bearing and cam member 32 when the rotatable member is moved sidewise towards the side frame 11*b* by any suitable power means able to handle the weight and size of this member with the fabrics or other materials wound thereon.

In this position the rotatable member is safe by reason of its inerta and the safety support and latching means 20 as above described.

Removal is effected by first swinging, pivoting or rolling the axle means 17 of this rotatable member to clear the bearing and cam member 32 from the safety support and latching member 20. Then, the rotatable member 10 can be lifted and removed by any suitable power operated means capable of handling the same in the manner above described.

It will be understood by those skilled in the art that the transport opening may be disposed in a vertical direction without departing from the scope of the present invention in which event the rotatable member will be lifted rather than pivoted or rolled as above described.

SPACED SUPPORT AND LATCHING MEANS

In the form of the invention shown in FIGS. 1 to 5 of the drawings and above described only single support and latching means was shown.

Figure 7:
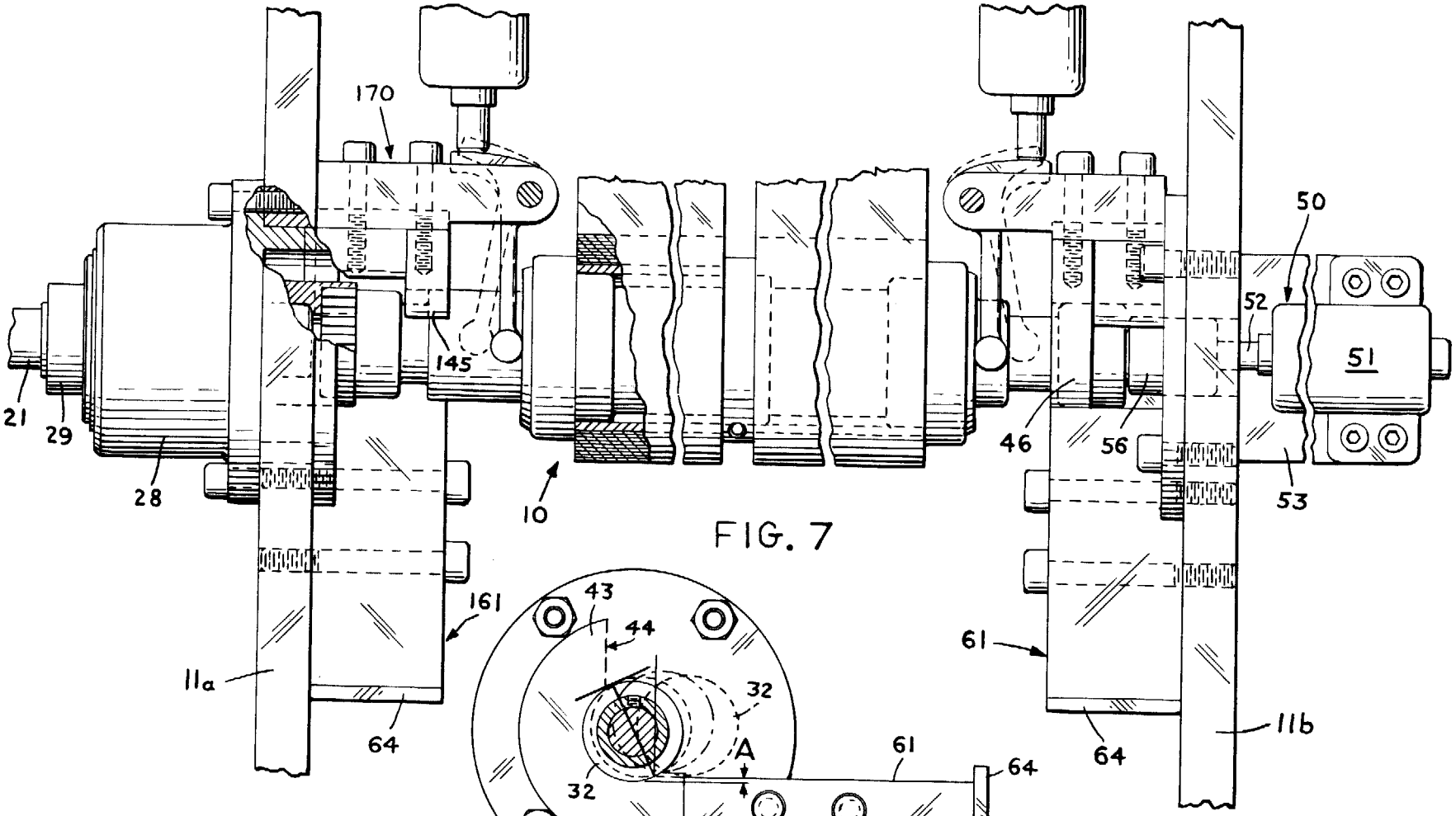
FIG. 7 is a top plan view of a rotatable member with an associate support and latching means supporting each of the respective ends of the rotatable member.

FIG. 7 shows a form of the present invention in which each end of the rotatable member is supported by a support and latching means. All the elements in FIG. 7 which are the same have been given the same character numerals. This form of the invention differs only by the addition of a support and latching member 120 at the driven end of the rotatable member 10.

The support and latching member 120 of the driven end of the rotatable member 10 differs somewhat from the form of the safety support and latching member 20 shown in FIGS. 1 to 5 and above described.

Support and latching member 120 has a bearing cavity as at 145 and a back-up section 146. The bearing cavity will be wide enough to permit the splines 23*a* and 24 to be moved into engagement and to be fully separated when the rotatable member 10 is in the disengaged position.

Additionally, the rotatable member will be provided with a roller bearing general designated 147 to aid in supporting and moving the rotatable member.

The operation is the same as above described for the form of the invention shown in FIGS. 1 to 5 of the drawings.

When the rotatable member is in the disengaged position, it can be swung or rolled onto the rest 61 and 161 and then lifted.

Thus, there has been disclosed a quick and simple means for mounting and removing a rotatable member which has safeguards to prevent escape or inadvertent accidents in the handling of these heavy elements during these steps, thus providing a more efficient machine and one that loses little in down time, because of changes in the rotatable member or rewind mandrel.

While the foregoing description of the novel apparatus discloses a preferred embodiment, it will be appreciated that certain changes and modifications may be made without departing from the spirit and scope of the invention. Accordingly, it is understood that the invention is not to be limited to any particular form or arrangement of parts, it shall have application to any apparatus wherein it is desired that rotatable members be safely but releasably secured and shall be limited only by the scope of the annexed claims.

What is claimed is:

1. A support and latching means for a rotatable member comprising:

a. a base for connecting the support and latching means adjacent to the end of the rotatable member to be supported, b. means forming a bearing in the axial line of the rotatable member, c. means forming an arcuate wall shaped to define a transfer cavity in the axial line of the rotatable member and concentric with the bearing, d. said arcuate wall means having a first portion thereon forming the lower support section of the transfer cavity and a second portion thereon continuous with the first portion forming an upper side section of the transfer cavity, e. the upper side section of the arcuate wall means disposed on one side of a plane intersecting the vertical axis through the center of the transfer cavity and extending from the lower support section to a point short of said plane of intersection with the vertical axis so as to define a transport opening for movement of the rotatable member to be supported into and out of the transfer cavity, f. means so connected adjacent the lower support section and on the side thereof opposite from the upper side section as to provide a supporting surface slightly higher than and parallel to a plane tangent to the lowermost portion of the transfer cavity formed by the lower support section of the arcuate wall means.

2. In a support and latching means as claimed in claim 1 wherein, a. the supporting surface comprises a laterally extended bracket connected to the arcuate wall means adjacent the lower support section thereof, and b. said surface being disposed approximately 0.1 inch above the lowermost portion of the transfer cavity formed by the lower support section.

3. In a support and latching member as claimed in claim 1 wherein the upper side section of the arcuate wall is short of the said plane of intersection taken through the center of the transfer cavity in a range from 8° to 20° from the top of said supporting surface.

4. In a support and latching member as claimed in claim 2 wherein the upper side section of the arcuate wall is short of the said plane of intersection taken through the center of the transfer cavity in a range from 8° to 20° from the top of the supporting surface.

5. A support and latching means for slidably and removably mounting the end of a rotatable member opposite from the driven end thereof comprising, a. a housing having a base for connecting the support and latching means adjacent the end of the rotatable member remote from the driven end thereof, b. said housing having an arcuate shaped section forming an arcuate shaped inner wall to define a transfer cavity for receiving said end of the rotatable member, remote from the driven end thereof, c. said arcuate shaped section having a first portion thereon forming the lower support section in said transfer cavity and a second portion thereon continuous with the first portion forming an upper side section disposed on one side of a plane intersecting the vertical axis through the center of the transfer cavity, said upper side section extending from the lower support section to a point short of said plane of intersection so as to define a transport opening for passing the said supported end of the rotatable member into and out of said transfer cavity, d. arcuate means on said housing adjacent the inner end of the transfer cavity forming a bearing means having a diameter equal to said transfer cavity, e. said bearing means and said transfer cavity in the axial line of the rotatable member, f. means so connected to said housing adjacent the lower supporting section and on the side thereof opposite from the upper side section as to provide a supporting surface slightly higher than and parallel to a plane tangent to the lowermost portion of the transfer cavity formed by the lower support section of the arcuate shaped section of the housing, g. actuating means for imparting sidewise motion to the supported end of the rotatable member, disposed on the side of the transfer cavity remote from the bearing means so the supported end of the rotatable member can be moved from said transfer cavity into said bearing means and into driving engagement at the end remote therefrom, and h. said arcuate means defining the bearing means forming an arc to substantially enclose the supported end of the rotatable member to prevent the same from escaping when moved into operating position in said bearing means.

6. In a supporting and latching means as claimed in claim 5 wherein, a. said supporting surface to provide a rest for said supported end of the rotatable member approximately 0.1 inch above the said plane of tangency.

7. In a support and latching means as claimed in claim 6 wherein the upper end of the upper side section is spaced from the said point of intersection in a range from 8° to 20°.

8. In a support and latching means as claimed in claim 7 wherein the means forming the bearing means including, a. latch means to prevent the rotatable member for escaping when the rotatable member is moved into position in the bearing means.

9. In a support and latching means or claimed in claim 5 including, a. second support and latching means on the end of said rotatable member remote from said first mentioned support and latching means.

10. The combination with a rotatable member disposed to be mounted between a first support means and a second support means spaced from said first support means, said rotatable member having driven means at one end and axle means at the other end thereof, a. driving means on said first support means, b. means for coupling said driving means to said driven means on movement of said rotatable member along its longitudinal axis, c. support and latching means on said second support means for slidably and releasably mounting the axle end of said rotatable means remote from said driven end, and d. actuating means connected to said second support adjacent said support and latching means and disposed to engage the end of the rotatable member for moving the same along its longitudinal axis into driving engagement with said driving means, e. first yoke means mounted on said first support means to extend about the driven end of the rotatable member, f. second yoke means connected adjacent the support and latching means, g. said second yoke means having spaced legs extending inboard of the support and latching means so that the open end faces in the direction for releasing said rotatable means whereby said rotatable means can be removed without dismantling said driving means, said first and second yoke means, and said support and latching means.

11. In the combination as claimed in claim 10 wherein said support and latching means includes, safety means to prevent said rotatable member from escaping when disposed for driving engagement and when disengaged from said driving means.

12. In the combination as claimed in claim 10 wherein the support and latching means includes, a. means forming a transfer cavity, b. said end of the shaft carried by said support and latching means disposed in said transfer cavity, c. said actuating means connected to said second support and disposed to extend into said transfer cavity for moving the rotatable member along its longitudinal axis into driving engagement with said driving means.

13. In the combination as claimed in claim 10, wherein the support and latching means includes, a. means forming a transfer cavity, b. said means having a transport opening therethrough to permit the axle end of the rotatable member supported by the support and latching means to be passed into and out of the transfer cavity, c. said means having a lower lip section at the transfer opening raised slightly above the plane of tangency with the lowermost end of the vertical axis through the center of said transfer cavity, and d. said actuating means connected to said support and latching means and disposed relative thereto to extend into said transfer cavity for moving to rotatable member along its longitudinal axis into driving engagement with said driving means.

14. In the combination as claimed in claim 13 including, a. means forming a supporting surface connected to the support and latching means and haing an upper surface thereon, and b. said upper surface of the said means forming a supporting surface slightly higher than the uppermost position of the lower lip section of the means forming the transport opening.

15. In the combination as claimed in claim 14 wherein the upper surface of the means forming a supporting surface is approximately .1 inch higher than the uppermost position of said lower lip section of the means forming the transfer opening.

* * * * *